US005932070A

United States Patent [19]

Esslinger et al.

[11] Patent Number: 5,932,070

[45] Date of Patent: Aug. 3, 1999

[54] PROCESS AND DEVICE FOR THE REMOVAL OF PAPER SHEET REMNANTS FROM A BELT

[75] Inventors: Klaus Esslinger, Nattheim; Gerhard Kotitschke, Steinheim; Wolfgang Mayer, Heidenheim; Andreas Meschenmoser, Horgenzell, all of Germany; Günther Mohrhardt, Sao Paolo, Brazil

[73] Assignee: Voith Sulzer Papiermaschinen GmbH, Heidenheim, Germany

[21] Appl. No.: 08/926,441

[22] Filed: Sep. 10, 1997

[30] Foreign Application Priority Data

Sep. 11, 1996 [DE] Germany ..... 196 36 791

[51] Int. Cl.[6] ..... D21F 7/04

[52] U.S. Cl. ..... 162/199; 162/252; 162/255; 162/272; 162/275

[58] Field of Search ..... 34/117, 120; 162/199, 162/198, 252, 255, 272, 275, 191; 15/309.1; 134/122 R, 64 R

[56] References Cited

U.S. PATENT DOCUMENTS 3,245,872 4/1966 Nelson ..... 162/255
5,493,790 2/1996 Brossard ..... 34/117
5,517,714 5/1996 Kotitschke ..... 15/309.1

FOREIGN PATENT DOCUMENTS 1029998 4/1978 Canada .
2263331 10/1975 France .
266235 10/1913 Germany .

OTHER PUBLICATIONS

Copy of a European Search Report dated Jan. 15, 1998, issued with EP App. No. 97111149.7–2314.

*Primary Examiner*—Peter Chin
*Assistant Examiner*—Steven B. Leavitt
*Attorney, Agent, or Firm*—Greenblum & Bernstein P.L.C.

[57] ABSTRACT

The present invention is directed to a device for removing at least one of paper sheet remnants and a paper sheet from a belt. The device may include a blow device including at least one blow opening extending lateral to a travel direction of the belt and a compressor coupled to the blow device to supply compressed air to the at least one blow opening. The at least one blow opening may be directed toward the at least one of the paper sheet remnants and the paper sheet to be removed.

20 Claims, 2 Drawing Sheets

PROCESS AND DEVICE FOR THE REMOVAL OF PAPER SHEET REMNANTS FROM A BELT

CROSS-REFERENCE TO RELATED APPLICATION

The present application claims priority under 35 U.S.C. § 119 of German Patent Application No. 196 36 791.3 filed Sep. 11, 1996.

BACKGROUND OF THE INVENTION

1. Field of the Invention

The present invention relates to a device and process for the removal of paper sheet remnants from a belt, and, in particular, for the removal of a paper sheet from a felt belt after sheet tear-off.

2. Discussion of Background Information

The paper sheet follows a bottom felt and is guided into a press break pulper either when the paper sheet is guided through a double felt press or when a sheet tears off. A joint run of the sheet with the bottom felt is generally favored by providing a smoother bottom felt, i.e. more finely needled, than the top felt. The joint run of the paper sheet and the bottom felt is further facilitated by the weight of the paper sheet and the run-off angle of the felt after the press nip. Thus, an earlier rear-ventilation of the top felt occurs.

However, it cannot always ensured that the paper sheet will be picked up reliably from the bottom felt and guided into the pulper. This is particularly the case during sheet tears.

In the prior art, the felt belt is guided around a smooth surface of the felt guide roll. The paper sheet remnants are moistened and removed from the felt with a scraper.

Thus, the paper sheet or sheet shreds may or may not be completely removed from the roll and, therefore, can reach the following pipe suction device via the felt belt, causing the pipe suction device to clog up. Further, because it can only be cleaned in a time-consuming manner, it is imperative that clogging of the pipe suction device be prevented at all cost to avoid undesirable periods of non-operation.

SUMMARY OF THE INVENTION

The present invention therefore provides a device and a process for removal of paper sheet remnants from a belt, and, in particular, for removal of a paper sheet from a felt during sheet tear-off. A reliable and gentle removal of the paper sheet from the belt may be ensured.

The present invention may provide a device that includes a blow unit having at least one blow opening and extending over paper sheet width. The blow unit may be pressurizable with compressed air directed at the paper sheet.

The present invention may provide a process in which compressed air may be blown through the belt and onto the paper sheet. In this manner, the paper sheet remnants may be removed.

During the start-up of a paper-making machine and after a sheet tear-off, which occurs during production, the blow unit may be pressurized with compressed air that is pressed through the belt. The blown air lifts off the paper sheet adhering to the belt. The paper sheet remnants may, via a suitable arrangement of the device relative to a pulper, be guided into the pulper.

In accordance with above, the potential danger of a paper jam is avoided. Further, the present invention does not require felt scrapers. Thus, undesirable felt wear on the paper sheet side of the belt may be avoided. The width and/or the number of blow openings may be adjusted to the permeability of the belt and to the running speed of the paper sheet so that safe removal of the paper sheet removal may be ensured, even at very high sheet run speeds.

The blow openings may be designed, e.g., as slits, and may be arranged, e.g., as a row of sequentially positioned bores.

The device and the process according to the invention not only can be used for the removal of paper sheet remnants from a felt belt, e.g, a press felt, but may also be implemented at other locations of a paper-making machine. For example, the device and process may also be utilized for the removal of paper sheet remnants from a screen in the screen section or from a dryer screen in the dryer section of a paper-making machine.

In a preferred embodiment of the present invention, a device may be provided for detecting a sheet tear-off. The device may by coupled to the blow unit for automated activation of a compressed air supply after detecting the sheet tear.

With the automatic activation of the compressed air supply, reliable removal of paper sheet remnants, e.g., in the case of a sheet tear-off, may be ensured. However, since the compressed air supply is only activated in the case of a sheet tear-off or in a targeted manner during the start-up of the paper machine, continuous usage of compressed air is not necessary.

In another embodiment of the present invention, the blow unit may be positioned after a press opening on the bottom felt. In this regard, because the paper sheet generally runs along with the bottom felt, this arrangement of the device of the present invention is advantageous. However, to prevent the paper sheet from adhering to the top felt during, e.g., an accidental joint run, a similar type device may be provided associated with the top felt.

The blow opening may be assigned to an entrance gusset of a subsequent roll in the travel direction of the sheet. In this manner, a certain overpressure may already exists in this area. Thus, a particularly suitable waste removal is provided by a substantially immediate deflection of the felt on the roll.

According to another embodiment of the present invention, the blow opening may be pressed onto a circulating belt so that a deflection angle of the belt of, e.g., approximately 3° to 10° is formed. Favorable guidance of the belt is, thus, provided and the removal of paper sheet remnants is likewise supported.

The removal of paper sheet remnants may be further assisted by positioning a moisturizing unit in front of the blow unit.

In another embodiment of the present invention, the air blast may be deactivated after transferring the paper sheet to the dryer section. In this manner, after transferring the sheet into the dryer section, an energy-saving operation is possible.

Further, the characteristic features of the present invention, as discussed herein, may be used, not only in the respective combinations shown, but also in other combinations or alone without departing from the spirit of the invention.

The present invention is directed to a device for removing at least one of paper sheet remnants and a paper sheet from a belt. The device may include a blow device including at least one blow opening extending lateral to a travel direction of the belt and a compressor coupled to the blow device to supply compressed air to the at least one blow opening. The at least one blow opening may be directed toward the at least one of the paper sheet remnants and the paper sheet to be removed.

In accordance with another feature of the present invention, the device may include a detection device that detects sheet tear-off being coupled to the blow device. The detection device may automatically activate the compressed air supply sheet tear-off is detected.

In accordance with another feature of the present invention, the blow device may be positioned after a press nip, in the travel direction, and adjacent a bottom felt.

In accordance with still another feature of the present invention, the blow device may be positioned after a press nip, in the travel direction, and adjacent a top felt.

In accordance with a further feature of the present invention, the device may include a guide roll positioned downstream of the blow device and the blow opening may be directed substantially toward a contact point of the belt and the guide roll.

In accordance with another feature of the present invention, the blow opening may be pressed against the belt to form a deflection angle between approximately 3° to 10°.

In accordance with still another feature of the present invention, the device may include a moistening device positioned upstream of the blow device.

In accordance with a still further feature of the present invention, the device may be actuated after a sheet tear to remove the paper sheet from the belt.

In accordance with another feature of the present invention, the belt may include one of a press felt and a screen.

The present invention is also directed to a process for removing at least one of paper sheet remnants and a paper sheet from a belt. The process may include detecting a sheet tear-off condition, blowing compressed air through the belt and in a direction of the at least one of the paper sheet remnants and the paper sheet to be removed. In this manner, the at least one of the paper sheet remnants and the paper sheet to be removed is lifted from the belt.

In accordance with another feature of the present invention, the process may also include automatically activating the compressed air supply after detecting the sheet tear-off condition.

In accordance with still another feature of the present invention, the process may also include guiding the paper sheet through a screen section that includes the belt, actuating an air blast through the belt, and rotating a pickup roll to transfer the paper sheet to a press section.

In accordance with a further feature of the present invention, the process may include guiding the paper sheet through a press section, guiding the paper sheet to a dryer section, and deactivating an air blast after guiding the paper sheet into a dryer section.

The present invention is also directed to a device for removing one of paper sheet remnants and a paper sheet from a belt. The belt may include a portion having a sheet width that is adapted to guide the paper sheet and the device, which may be used in a machine that includes at least a screen section, a press section and a dryer section, may include a blower device positioned adjacent the belt and extending at least across the sheet width of the portion, the blower having a compressed air output directed toward a first surface of the belt, and a pulper device that collects the removed one of the paper sheet remnants and the paper sheet. The blower device may lift the one of the paper sheet remnants and the paper sheet from the second surface of the belt.

In accordance with another feature of the present invention, the device may be located within the press section and downstream, relative to a travel direction of the belt, of a shoe press. The device may be positioned upstream of a belt guide roll. Further, the device may be positioned downstream of a pick up roll for the dryer section. The device may also include a sheet-tear detection device located within the dryer section. The blower device may be actuated when a sheet-tear condition is detected. Still further, a moistening device may be positioned upstream of the blower device.

In accordance with a still further feature of the present invention, a scraper device and a moistening device may be associated with the belt guide roll.

In accordance with yet another feature of the present invention, the device may be located within the screen section and downstream, relative to a travel direction of the belt, of a pickup roll for the press section. The device may be positioned upstream of a screen guide roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
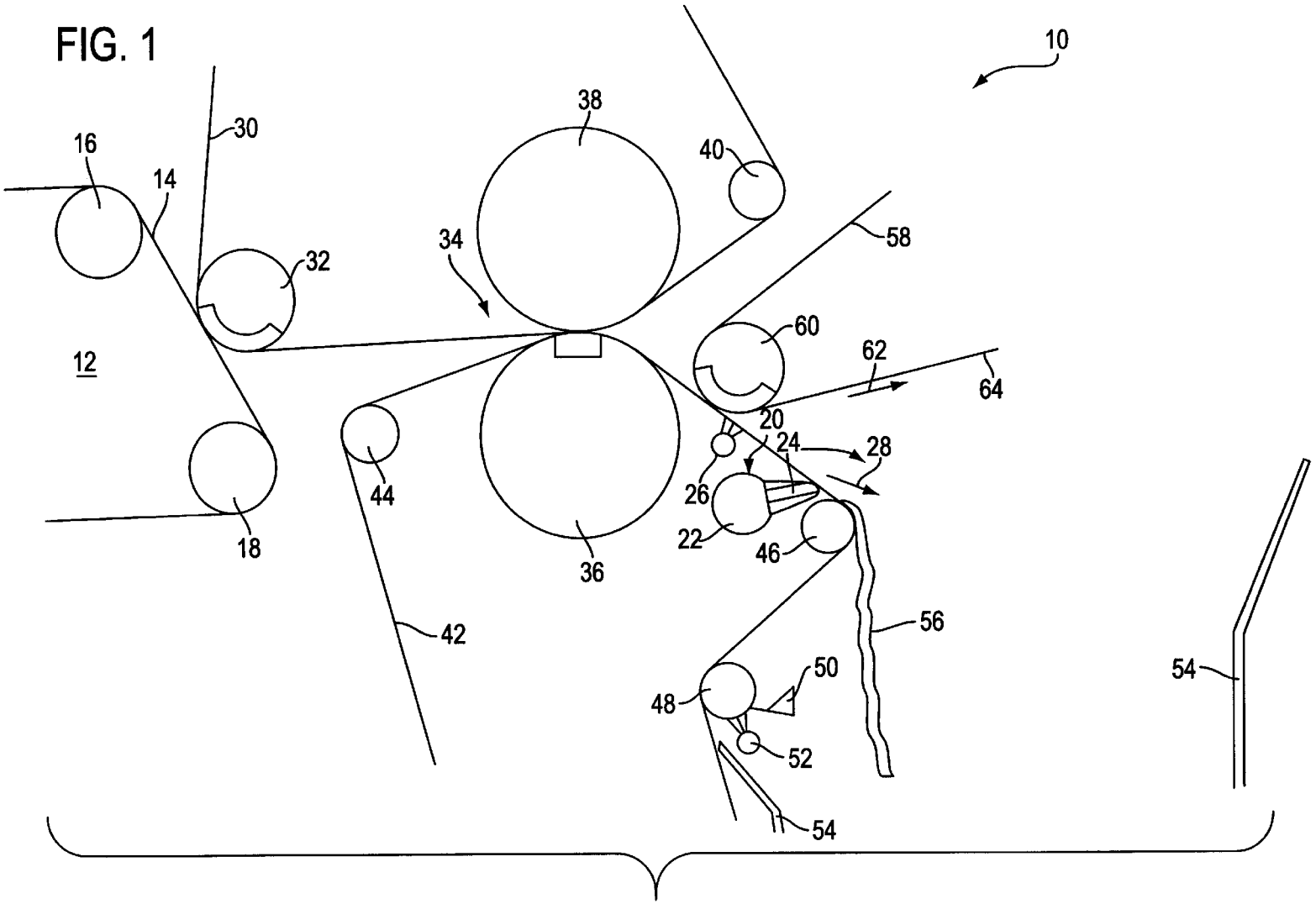
FIG. 1 illustrates an press section within a paper-making machine in which the device of the present invention is utilized with a bottom felt.

FIG. 1 illustrates a press section 10 which may be utilized in a paper-making machine. A screen section 12 may be positioned to precede press section 10 and may include a screen 14 guided around a plurality of screen guide rolls, of which only screen guide rolls 16 and 18 are shown. A paper sheet 64 may be lifted off or removed from screen 14 by a transfer or pickup roll 32 with, e.g., suction assistance. Paper sheet 64 may then be guided to a press nip or gap 34 via a top felt 30.

Press nip 34 may be formed by a shoe press including a bottom shoe press roll 36 and a top-mounted mating roll 38.

Bottom shoe press roll 36 may be, e.g., a deflection adjustment roll. After passing through press nip 34, top felt 30 may be guided around a plurality of felt guide rolls, of which felt guide roll 40 is shown, back to transfer roll 32.

Further, a bottom felt 42 may be guided through press nip 34 and may be guided around or over a plurality of felt guide rolls, of which felt guide rolls 44, 46, and 48 are shown. Thus, paper sheet 64 is positioned between top felt 30 and bottom felt 42 through press nip 34. After passing through press nip 34, paper sheet 64 may be transferred onto a dryer screen 58 a suction roll 60 and guided to a subsequent dryer section in a direction of arrow 62.

Top felt 30 and bottom felt 42 may be formed by an air permeable fabric, preferably a mono- or multi-filament fabric (needled), e.g., of polyamide. Further, the felts may have a surface weight of, e.g., between approximately 500–2000 $gm^2$. Screen 14 may be formed by a water- and air-permeable fabric, e.g., a one- or multi-ply fabric, e.g., of polyamide or polyethylene.

Depending on the specific design of the paper-making machine, a plurality of press nips may be provided.

In accordance with the present invention, a device 20 may be provided on an interior surface of bottom felt 42, i.e., the surface opposite the surface for guiding paper sheet 64, and may be positioned downstream of, with respect to the travel direction of bottom felt 42, press nip 34 and suction roll 60. Device 20 may include a blow unit having a blow box 22 positioned upsteam of following felt guide roll 46 and a slit-shaped blow opening 24. Slit-shaped blow opening 24 may discharge compressed air to be blown through bottom felt 42, thus, lifting up or removing paper remnants from bottom felt 42, e.g., during a start-up of the paper machine or in response to a sheet tear-off, and transporting or directing the removed paper sheet remnants, in a direction indicated by arrows 28, to a pulper 54. Pulper 54 may be positioned, e.g., underneath device 20 to receive the removed remnants, as depicted by the sheet knock-off 56.

Nozzle 22 may have a nozzle width of, e.g., between approximately 1–20 mm, and preferably between approximately 5–10 mm. Further, nozzle 22 may provide a blast velocity of, e.g., between approximately 5–50 m/s, and preferably between approximately 20–30 m/s.

Device 20 may further include a spray pipe 26 positioned immediately upstream of blow box 22 and directed toward the interior surface of bottom felt 42 for moistening bottom felt 42. The moistening of bottom felt 42 may further facilitate removal of paper sheet remnants.

Blow box 22 may be arranged so that bottom felt 42 is pushed out at an angle of, e.g., approximately 3° to 10° and blow opening 24 may be directed toward an immediate area of a gusset of felt guide roll 46.

Following felt guide roll 48 may have a smooth surface and may be positioned to contact the surface of bottom felt 42 that guides paper sheet 64. A scraper 50 and another spray pipe 52 may be provided adjacent felt guide roll 48 to remove additional paper sheet remnants adhering thereto from bottom felt 42.

Figure 2:
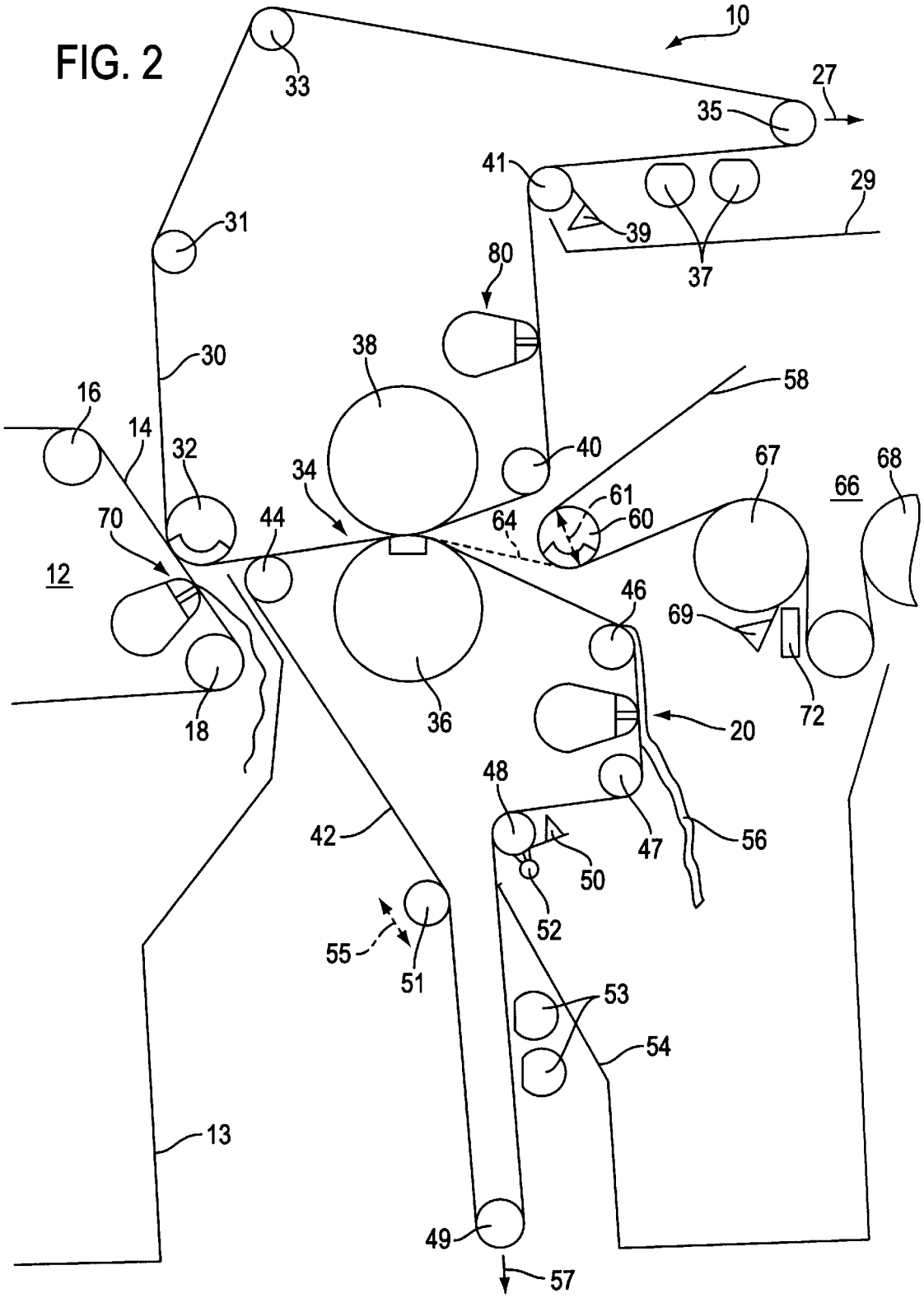
FIG. 2 illustrates a press section, as well as a preceding screen section and a following dryer section, in which the device of the present invention is utilized with the bottom felt and the top felt, as well as the screens in the screen section.

FIG. 2 illustrates a more detailed press section 10 that shows an exemplary view of the guide path for top felt 30 and of bottom felt 42. Further, in addition to device 20, which is positioned adjacent bottom felt 42, an additional device 80 may be positioned adjacent to an interior surface, i.e., the surface opposite the surface for guiding paper sheet 64, of top felt 30. A third device 70 may by positioned adjacent an interior surface of screen 14 of screen section 12.

As discussed with respect to FIG. 1, paper sheet 64 may be removed from screen 14 via a transfer or pickup roll 32 and may be guided through press nip 34 between top and bottom felts 30 and 42. Paper sheet remnants adhering to screen 14 after the removal or transfer of paper sheet 64 to press section 10 may be removed from the screen in a manner similar to that discussed in FIG. 1 with respect to device 20. That is, device 70 may be positioned to direct a flow of compressed air through screen 14 to blow off adhering paper sheet remnants and transport the remnants into a pulper 13 positioned underneath device 70.

Further to the above description provided with respect to FIG. 1, top felt 30 may be guided or deflected by additional felt guide rolls 41, 35, 33, and 31 in an endless path. In a conventional manner, one of the felt guide rolls, e.g., felt guide roll 35, may be adjustable in a direction of arrow 27 to set a desired felt tension.

Further, a felt conditioning system may be utilized which includes a pipe suction device 37 positioned between felt guide rolls 41 and 35, and a scraper 39 contacting an outer surface of felt guide roll 41. Further, a spray pipe may optionally be included to further enhance removal of sheet remnants. A trough 29 may be positioned below the felt conditioning system to receive removed captured fluid and remnants.

A device 80 may be provided adjacent belt 30 and between first felt guide roll 40 and felt guide roll 41. In accordance with this arrangement, felt guide roll 41 may be positioned above felt guide roll 40 so that the removal of paper sheet remnants or the paper sheet from belt 30 may be accomplished via the air blast from device 80.

Bottom felt 42 may be deflected over a plurality of guide rolls, e.g., felt guide rolls 44, 46, 47, 48, 49, and 51 in a generally conventional manner. As in the embodiment configured in FIG. 1, a scraper 50 and a spray pipe 52 may be positioned adjacent the outer felt guide roll 48 on the paper sheet guiding or contacting side to remove any further adhering paper sheet remnants. Device 20 is shown located between first felt guide roll 46 and following felt guide roll 47 and is positioned to blow paper sheet remnants off of bottom felt 42 and into pulper 54, as discussed above.

A lowest felt guide roll 49 of which bottom felt 42 is guided around, may be adjustable downward, e.g., in a direction of arrow 57, to set the desired felt tension, in a conventional manner. Further, following felt guide roll 51, which may be located above felt guide roll 49, may be diagonally adjustable in a direction indicated by double-arrow 55.

A felt conditioning device may be positioned between felt guide roll 48 and felt guide roll 49 and adjacent the exterior surface of bottom felt 42. The felt conditioning device may include a pipe suction unit 53 to be utilized in a conventional manner.

In the embodiment depicted in FIG. 2, paper sheet 64 may run together with bottom felt 42 and may, therefore, be blown off bottom felt 42 with the compressed air from device 20. This situation generally occurs, e.g., during start-up of the paper machine, when paper sheet 64 is to be transferred to suction roll 60 and guided, via dryer screen 58, around dryer cylinders 67 and 68 of dryer section 66, but the transfer does not occur and the sheet adheres to, e.g., bottom felt 42.

To avoid the undesired adhesion of paper sheet 64 to bottom felt 42 after transfer to dryer section 66, suction roll 60 may be rotatable or movable, e.g., in an arcuate path, in the direction of double arrow 61 and may, therefore, be moved or rotated against bottom felt 42 in order to transfer or pick-up paper sheet 64 onto dryer screen 58 via, e.g., suction, and then move to a position away from bottom felt 42, as indicated by dotted line 64. During production operation of the paper-making machine, suction roll 60 may remain in the position rotated away from bottom felt 42, e.g., in a position as shown in FIG. 2, so that the paper sheet can be directly transferred onto dryer screen 58.

A detection device 72, which may include one or more sensors, may be positioned downstream of a first dryer cylinder 67 to to recognize a sheet tear occurring during production. If a sheet tear-off is detected by the sensors of detection device 72, devices 20 and 80, which may be normally maintained in a depressurized condition during production, may be activated to direct their compressed air blasts through their respective belts. In this manner, paper sheet remnants that may be running with bottom felt 42 or that may be running along with top felt 30 are blown off of the felts so as to fall into pulper 54.

Further, it is within the purview of the present invention that blow opening 24 of blow box 22 may be either a single blow opening or a plurality of blow openings. Still further, the shape and size of the openings, and in particular the width of the blow openings, may be adjusted in accordance with the paper sheet run speed and other parameters, e.g., paper weight, etc. However, when a single blow opening is utilized, the blow opening extends over at least the width portion of the belt that guides the paper sheet.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A web producing apparatus having a device for removing at least one of paper sheet remnants and a paper sheet from a belt, comprising:

a belt adapted to guide a paper sheet;

a press nip adapted to press the paper sheet and the belt;

a blow device including at least one blow opening extending laterally to a travel direction of the belt, the blow device being positioned after a press nip, in the travel direction, and adjacent a bottom belt;

a compressor coupled to the blow device to supply compressed air to the at least one blow opening; and the at least one blow opening being directed toward the at least one of the paper sheet remnants and the paper sheet to be removed.

2. The device according to claim 1, further comprising:

a detection device that detects sheet tear-off being coupled to the blow device, wherein the detection device automatically activates the compressed air supply when sheet tear-off is detected.

3. The device according to claim 1, the blow device being positioned after a press nip, in the travel direction, and adjacent a top felt.

4. The device according to claim 1, further comprising a guide roll positioned downstream of the blow device; and the blow opening being directed substantially toward a contact point of the belt and the guide roll.

5. The device according to claim 1, the blow opening being pressed against the belt to form a deflection angle between approximately 3° to 10°.

6. The device according to claim 1, further comprising:

a moistening device positioned upstream of the blow device.

7. The device according to claim 1, wherein the device is actuated after a sheet tear to remove the paper sheet from the belt.

8. The device according to claim 1, the belt comprising one of a press felt and a screen.

9. A process for removing at least one of paper sheet remnants and a paper sheet from a belt, the process comprising:

detecting a sheet tear-off condition;

blowing compressed air through the belt and in a direction of the at least one of the paper sheet remnants and the paper sheet to be removed, whereby the at least one of the paper sheet remnants and the paper sheet to be removed is lifted from the belt.

10. The process according to claim 9, further comprising automatically activating the the compressed air supply after detecting the sheet tear-off condition.

11. The process according to claim 9, further comprising:

guiding the paper sheet through a screen section that includes the belt;

actuating an air blast through the belt; and rotating a pickup roll to transfer the paper sheet to a press section.

12. The process according to claim 9, further comprising:

guiding the paper sheet through a press section;

guiding the paper sheet to a dryer section; and deactivating an air blast after guiding the paper sheet into a dryer section.

13. A device for removing one of paper sheet remnants and a paper sheet from a belt including a portion having a sheet width that is adapted to guide the paper sheet, the device, for use in a machine including at least a screen section, a press section and a dryer section, comprising:

a blower device positioned adjacent the belt and extending at least across the sheet width of the portion;

the blower having a compressed air output directed toward a first surface of the belt; and a pulper device that collects the removed one of the paper sheet remnants and the paper sheet, wherein the blower device lifts the one of the paper sheet remnants and the paper sheet from the second surface of the belt.

14. The device according to claim 13, the device being located within the press section and downstream, relative to a travel direction of the belt, of a shoe press;

the device being positioned upstream of a belt guide roll.

15. The device according to claim 14, the device being positioned downstream of a pick up roll for the dryer section.

16. The device according to claim 15, further comprising a sheet-tear detection device located within the dryer section, wherein the blower device is actuated when a sheet-tear condition is detected.

17. The device according to claim 15, further comprising a moistening device positioned upstream of the blower device.

18. The device according to claim 13, further comprising a scraper device and a moistening device associated with the belt guide roll.

19. The device according to claim 13, the device being located within the screen section and downstream, relative to a travel direction of the belt, of a pickup roll for the press section;

the device being positioned upstream of a screen guide roll.

20. A device for removing at least one of paper sheet remnants and a paper sheet from a belt, comprising:

a blow device including at least one blow opening extending laterally to a travel direction of the belt, the blow device being positioned after a press nip, in the travel direction, and adjacent a bottom belt;

a compressor coupled to the blow device to supply compressed air to the at least one blow opening; and the at least one blow opening being directed toward the at least one of the paper sheet remnants and the paper sheet to be removed.

* * * * *